United States Patent [19]

Zimmer

[11] Patent Number: 5,035,177

[45] Date of Patent: Jul. 30, 1991

[54] DEVICE FOR CLEANING CYLINDRICAL STENCILS

[76] Inventor: Johannes Zimmer, Ebentalerstrasse 133, A-9020 Klagenfurt, Austria

[21] Appl. No.: 583,295

[22] Filed: Sep. 17, 1990

[30] Foreign Application Priority Data

Sep. 19, 1989 [DE] Fed. Rep. of Germany ... 8911282[U]

[51] Int. Cl.[5] ..... B41F 35/02

[52] U.S. Cl. ..... 101/425; 101/120; 15/88; 15/104.04

[58] Field of Search ..... 101/423, 424, 425, 120, 101/129; 15/88, 104.03, 104.04

[56] References Cited

U.S. PATENT DOCUMENTS 3,438,078 4/1969 Muselaers ..... 15/88
3,987,511 10/1976 Mayer et al. ..... 15/88

FOREIGN PATENT DOCUMENTS 2801878 7/1978 Fed. Rep. of Germany ..... 101/425

*Primary Examiner*—Clifford D. Crowder
*Assistant Examiner*—Stephen R. Funk
*Attorney, Agent, or Firm*—Lorusso & Loud

[57] ABSTRACT

A device for cleaning cylindrical stencils comprising two pivoted, cylindrical cleaning brushes, on which the stencil rests during the cleaning process in a position inclined to the horizontal line. The tub carrying the cleaning brushes is pivotally mounted about a horizontal axis.

8 Claims, 2 Drawing Sheets

DEVICE FOR CLEANING CYLINDRICAL STENCILS

The invention to a device for cleaning cylindrical stencils comprising two cylindrical brushes rotatably mounted in a tub, the stencil resting on said brushes in a position inclined with respect to a horizontal line during the cleaning process.

Devices for cleaning cylindrical stencils, as particularly used in the field of textile printing, may be divided into two major groups.

A first group is characterized by a vertically standing washing box. The stencil to be cleaned is brought into this washing box by being pulled over an initially horizontally extending sprinkler pipe and then being tilted upwardly together with the sprinkler pipe and being enclosed in the cleaning container.

It is a particular advantage of these devices that they only require little space. It is disadvantageous that, without support, only short stencils can be tilted upwardly or treated. The treatment is essentially limited to spraying off the inner and outer surfaces of the stencil, though the use of a ring brush for stencils of a standard diameter has already been suggested.

The second group of known stencil washing devices comprises the features outlined at the outset. The advantage of such a device lies in the fact that the fragile stencils are supported over their whole length so that damages during the washing process do not occur. It is disadvantageous that the inclination of the cleaning brushes or of the stencils to be cleaned is very limited, if the introduction of the stencils into the device and the removing thereof has to be accomplished by an operating person standing on the floor.

The object of the present invention is to support the stencil by means of rotating cylinder brushes during operation and, at the same time, to obtain a considerable inclination in the range of 20°–60° at least in the end phase of the treatment. With such a inclination, not only color residues would be able to flow off more easily, but also, liquid residues would be prevented from accumulating in the region of the lower end ring, which have to be removed after the actual cleaning process.

In accordance with the above object, the present invention provides that the tub supporting the cleaning brushes is pivotally mounted about a horizontal axis.

When washing in a vertical arrangement, the time required for tilting up- and downwardly for the cleaning process is lost. Therefore, the tilting process has to be accomplished with the largest acceleration possible, which requires considerably higher construction efforts. As the process of washing the sieve cylinders or stencils forms part of a complex change-over process, the cleaning time should be as short as possible; otherwise, standstill times of a very expensive production installation will occur.

In accordance with the present invention, this disadvantage can be avoided by appropriate process control by setting the support means in operation already during the tilting process. However, a rotation of the cylindrical stencil by means of the fast running cylindrical brushes should occur only if large color accumulations, which would have to be supported by the cylindrical brushes, are no longer present in the stencil.

Further suitable features, embodiments, and examples of the invention follow from the dependent claims and the diagrammatic drawing that will be described in the following.

Figure 1:
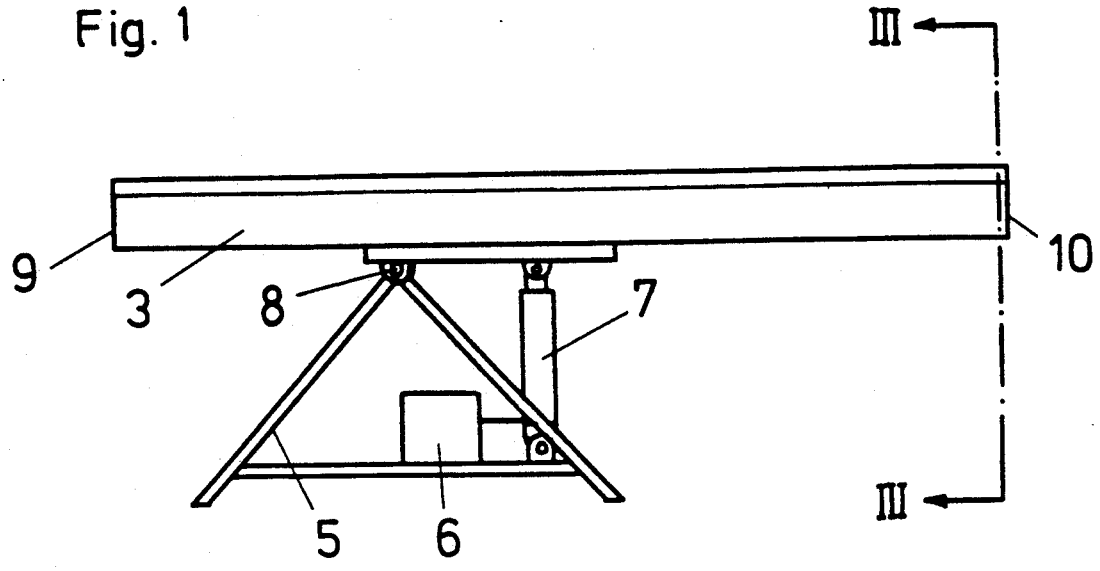
FIG. 1 shows a diagrammatic side view of an embodiment in a loading position.

Two known (e.g. from Austrian Patent No. 284 169) cleaning brushes 1,2, upon which a stencil 11 to be cleaned rests, are essential parts of the illustrated invention. A sprinkler pipe 4 mounted to a closed end 9 (left end according to FIGS. 1 and 2) of a tub 3 carrying the cleaning brushes 1,2 serves to clean the interior of the stencil 11. The end of the sprinkler pipe 4 facing the other end 10 of the tub 3 is free so that the stencil can be pulled over the sprinkler pipe 4.

It is a novel suggestion with the device shown to pivotally mount the tub 3 on a bearing block 5 so that it can be tilted about an axis 8. The tilting movement takes place by means of drive 6 reacting on the hydraulic unit 7.

By the tiltable arrangement of the tub 3, it is possible to introduce the stencil 11 into the device, while the tub 3 is in the horizontal position shown in FIG. 1. In order to be able to keep the bearing block 5 low, the axis 8 of rotation is situated relatively close to the closed end 9 of the bub 3.

Figure 2:
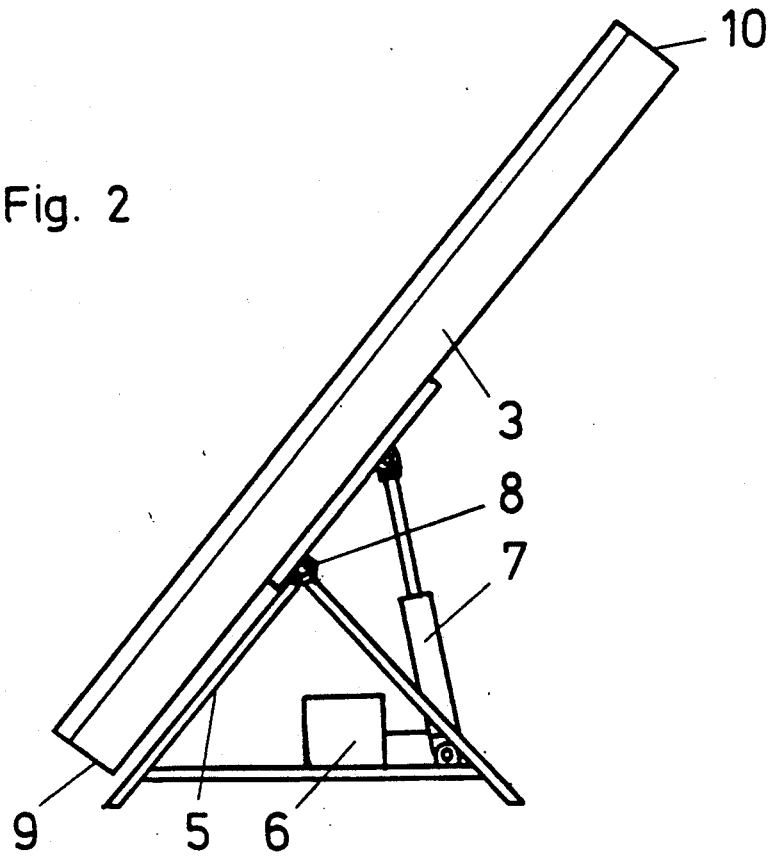
FIG. 2 shows a diagrammatic view of the device in an operating position.
Figure 3:
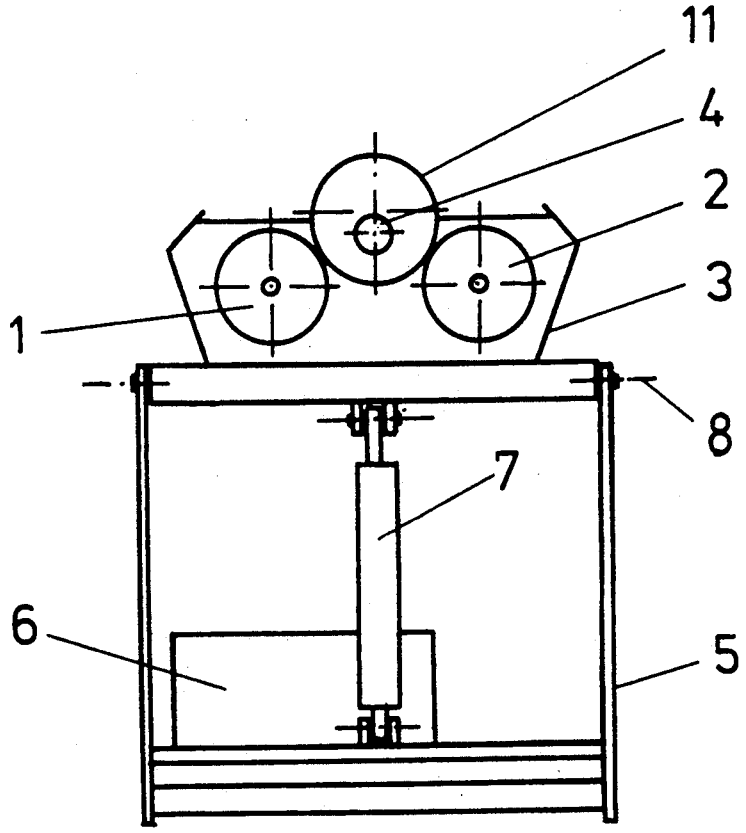
FIG. 3 shows a section according to the line III—III of FIG. 1.

A perfect flow off of color residues and the cleaning liquid is guaranteed by tilting the arrangement upwardly to the position shown in FIG. 2. The supply of the cleaning liquid is made (in a manner not shown) from the end 9 of the tub 3 by means of the sprinkle pipe 4 and possibly by mean of further sprinkle pipes arranged in a per se known manner around the exterior side of the stencil. The drive for the cleaning brushes 1,2, which is also not shown, will advantageously be turned on only if the color accumulations in the lower, brush-near region of the stencil 11 are removed. The entire cleaning process including the rotation and exterior cleaning of the stencil 11 by means of the brushes 1,2 rotating at different speeds, however, may already begin as the tub 3 is tilted upwardly. During tilting the tub downwardly, however, no further cleaning water is supplied to avoid water accumulations in the region of the lower end ring of the stencil 11. During the downward tilting, however, the stencil may be air-dried.

What is claimed is:

1. A device for cleaning a cylindrical stencil comprising two cylindrical brushes rotatably mounted in a tub along the tub's longitudinal axis, said stencil resting on said brushes during the cleaning process, and means pivotally mounting said tub about a horizontal axis transverse to said longitudinal axis to tilt said tub with respect to the horizontal axis during the cleaning process.

2. The device according to claim 1, wherein the horizontal axisx is located at different distances from opposite ends of the tub.

3. The device according to claim 2, wherein said means for pivotally mounted said tub is a bearing block located at said horizontal axis which allows said tub to tilt from a horizontal loading position to a inclined operating position, said inclined operating position forming an angle of at least 20 degrees with the horizontal loading position.

4. The device according to claim 3, further comprising a sprinkle pipe adapted to be supplied with a cleaning liquid while said tub is tilting, said sprinkle pipe being fixed to one end of said tub.

5. The device according to claim 2, further comprising a sprinkle pipe adapted to be supplied with a cleaning liquid while said tub is tilting, said sprinkle pipe being fixed to one end of said tub.

6. The device according to claim 1, wherein said means for pivotally mounting said tub is a bearing block located at said horizontal axis which allows said tub to tilt from a horizontal loading position to a inclined operating position, said inclined operating position forming an angle of at least 20 degrees with the horizontal loading position.

7. The device according to claim 6, further comprising a sprinkle pipe adapted to be supplied with a cleaning liquid while said tub is tilting, said sprinkle pipe being fixed to one end of said tub.

8. The device according to claim 1, futher comprising a sprinkle pipe adapted to be supplied with a cleaning liquid while said tub is tilting, said sprinkle pipe being fixed to one end of said tub.

* * * * *